US007686102B2

(12) United States Patent
Swinford

(10) Patent No.: US 7,686,102 B2
(45) Date of Patent: Mar. 30, 2010

(54) JET MOTOR FOR PROVIDING ROTATION IN A DOWNHOLE TOOL

(76) Inventor: Jerry Swinford, 19511 Wied Rd, Suite 8, Spring, TX (US) 77388

( * ) Notice: Subject to any disclaimer, the term of this patent is extended or adjusted under 35 U.S.C. 154(b) by 0 days.

(21) Appl. No.: 11/693,568

(22) Filed: Mar. 29, 2007

(65) Prior Publication Data

US 2007/0227779 A1 Oct. 4, 2007

Related U.S. Application Data

(60) Provisional application No. 60/787,906, filed on Mar. 31, 2006.

(51) Int. Cl.
*E21B 4/02* (2006.01)

(52) U.S. Cl. ..... 175/107; 415/903

(58) Field of Classification Search ..... 175/107; 415/202, 903, 904

See application file for complete search history.

(56) References Cited

U.S. PATENT DOCUMENTS

| | | | | |
|---|---|---|---|---|
| 1,727,276 | A | | 9/1929 | Diehl |
| 1,860,214 | A | | 5/1932 | Yeaman |
| 2,944,792 | A | * | 7/1960 | Gros ..... 175/107 |
| 3,133,603 | A | | 5/1964 | Lagacherie |
| 3,844,362 | A | | 10/1974 | Elbert |
| 4,440,242 | A | | 4/1984 | Schmidt |
| 4,529,046 | A | | 7/1985 | Schmidt |
| 5,101,916 | A | | 4/1992 | Lesh |
| 5,385,407 | A | | 1/1995 | De Lucia |
| 5,518,379 | A | * | 5/1996 | Harris et al. ..... 418/11 |
| 5,833,444 | A | * | 11/1998 | Harris et al. ..... 418/113 |
| 6,520,271 | B1 | | 2/2003 | Martini |
| 6,527,513 | B1 | * | 3/2003 | Van Drentham-Susman et al. ..... 415/202 |

* cited by examiner

*Primary Examiner*—David J Bagnell
*Assistant Examiner*—Robert E Fuller
(74) *Attorney, Agent, or Firm*—Keeling Patents & Trademarks LLC; Melissa M. Martinez; Kenneth A. Keeling

(57) ABSTRACT

The invention comprises a downhole jet motor, and a method of using same, that can be utilized to drill or to clean a well bore or tubing. The jet motor comprises a power shaft partially surrounded by a control sleeve defining a blind annular space, closed at the upper end and open at the lower end to allow fluid discharge. At least one opening is provided in the drive shaft wall extending radially within the annulus region. Drilling or cleaning fluid pressure is directed to the at least one opening in the power shaft. The control sleeve provides a reaction structure in relation to fluid discharged from the at least one opening producing rotation of the drive shaft in relation to the control sleeve.

18 Claims, 6 Drawing Sheets

JET MOTOR FOR PROVIDING ROTATION IN A DOWNHOLE TOOL

CROSS-REFERENCE TO RELATED APPLICATIONS

This application claims the benefit of U.S. Provisional Patent Application No. 60/787,906 entitled, "Downhole Tool," filed on Mar. 31, 2006, in the United States Patent and Trademark Office.

STATEMENT REGARDING FEDERALLY SPONSORED RESEARCH OR DEVELOPMENT

Not Applicable.

BACKGROUND OF THE INVENTION

1. Field of the Invention

The present invention relates in general to a downhole drilling and cleaning apparatus. More specifically, the invention is directed to a motor and apparatus for cleaning out production tubing, for drilling oil and gas wells and like applications.

2. Description of the Related Art

The use of hydraulically driven drill bits is known in the art as described in the following U.S. patents.

U.S. Pat. No. 1,727,276, issued to Diehl on Sep. 3, 1929, discloses a drill bit rotating at one speed and a body portion rotating at a second lower speed. Once the drill bit engages a hard formation the drill bit and the body combine and rotate at the speed of the body portion.

U.S. Pat. No. 1,860,214, issued to Yeaman on May 24, 1932, discloses a hydraulically rotating drill bit with exhaust passages through the bit body for the escape of impelling fluid.

U.S. Pat. No. 3,133,603, issued to Lagacherie, et al on May 19, 1964, discloses a fluid driven-bit wherein fluid passes over an internal turbine. The fluid acts upon the internal turbine in order to rotate the drill bit.

U.S. Pat. No. 3,844,362, issued to Elbert, et al on Oct. 29, 1974, discloses a device for boring holes comprising a body having a front end and a rear end wherein forward drive means are provided at the rear end for receiving pressurized fluid. A boring head is rotatably mounted in the body and projects from the front end of the body. Passages direct fluid from the boring head to impart torque to the boring head.

U.S. Pat. Nos. 4,440,242 and 4,529,046, issued to Schmidt, et al on Apr. 3, 1984 and Jul. 16, 1985 respectively, disclose a drilling apparatus having nozzles functioning as cutting jets and passages discharging radially to generate torque for rotation.

U.S. Pat. No. 5,101,916, issued to Lesh for on Apr. 7, 1992, discloses a fluid-driven tool wherein pressurized fluid is used to create rotation by force applied to internal helical vanes.

U.S. Pat. No. 5,385,407, issued to De Lucia on Jan. 31, 1995, discloses a tool having three sections wherein lubricant is permitted to flow through orifices to lubricate the bearing assembly.

U.S. Pat. No. 6,520,271, issued to Martini on Feb. 18, 2003, discloses a fluid-driven tool wherein pressurized fluid is used to create rotation by internal vanes.

The prior art does not disclose a downhole motor capable of generating rotational and thrust torque with radially-extending nozzles in cooperation with a control sleeve.

The prior art does not disclose a downhole motor capable of generating significant torque utilizing a fluid comprising either a liquid or a gas.

It is a further object of the present invention to provide a downhole drilling and cleaning tool having a plurality of nozzles providing rotational and forward thrust in cooperation with a control sleeve.

BRIEF SUMMARY OF THE INVENTION

The present invention comprises a jet motor downhole tool that can be utilized to drill or to clean a well bore or tubing associated therewith. The jet motor includes a motor comprising drive nozzles at a power shaft generating rotational torque acting in cooperation with a control sleeve. The jet motor connects to an upper member that is in fluid communication with the source of drilling or cleaning fluid. Drilling or cleaning fluid pressure is directed to nozzles in the power shaft extending generally in a radial direction. The nozzles may be oriented at an axial angle obtusely to provide downward force. The power shaft rotates in relation to a control sleeve spaced from the power shaft, the control sleeve providing a reaction structure in relation to fluid discharged from the nozzles. The control sleeve and the power shaft define a blind annular space, closed at the upper end and open at the lower end to allow fluid discharge.

Other features and advantages of the invention will be apparent from the following description, the accompanying drawings and the appended claims.

DESCRIPTION OF THE INVENTION

Figure 1:
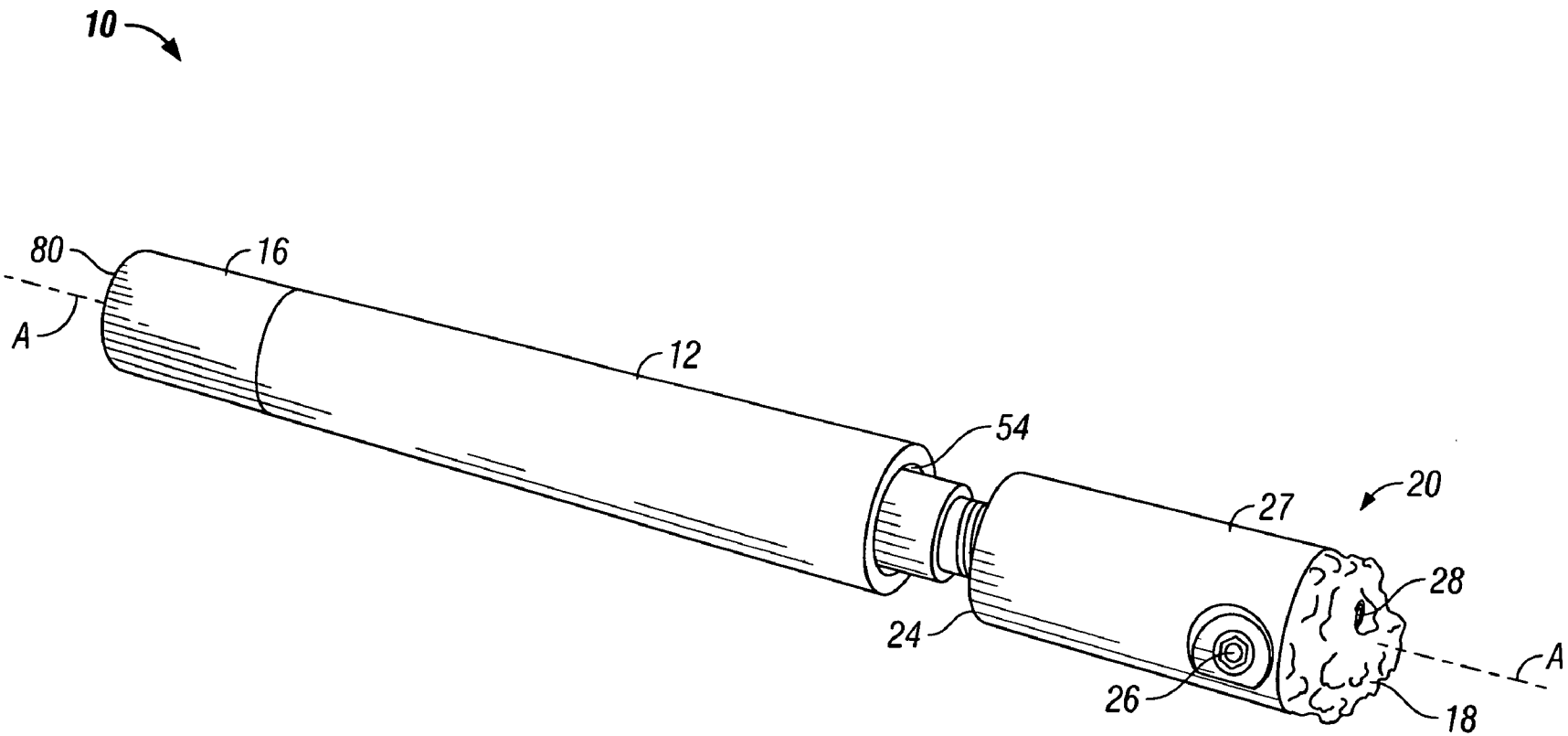
FIG. 1 is a side view of the jet motor as fully assembled.

Referring to FIG. 1, the exterior of the present invention 10 generally comprises a drill bit 20, control sleeve 12, and upper subassembly 16 having a common central longitudinal axis AA.

As used herein, "upper" will refer to the direction of upper end 80 of upper subassembly 16 that connects to a drill string or tubing (not shown). As used herein, "lower" will refer to the direction of the drill face 18 of drill bit 20.

Figure 2:
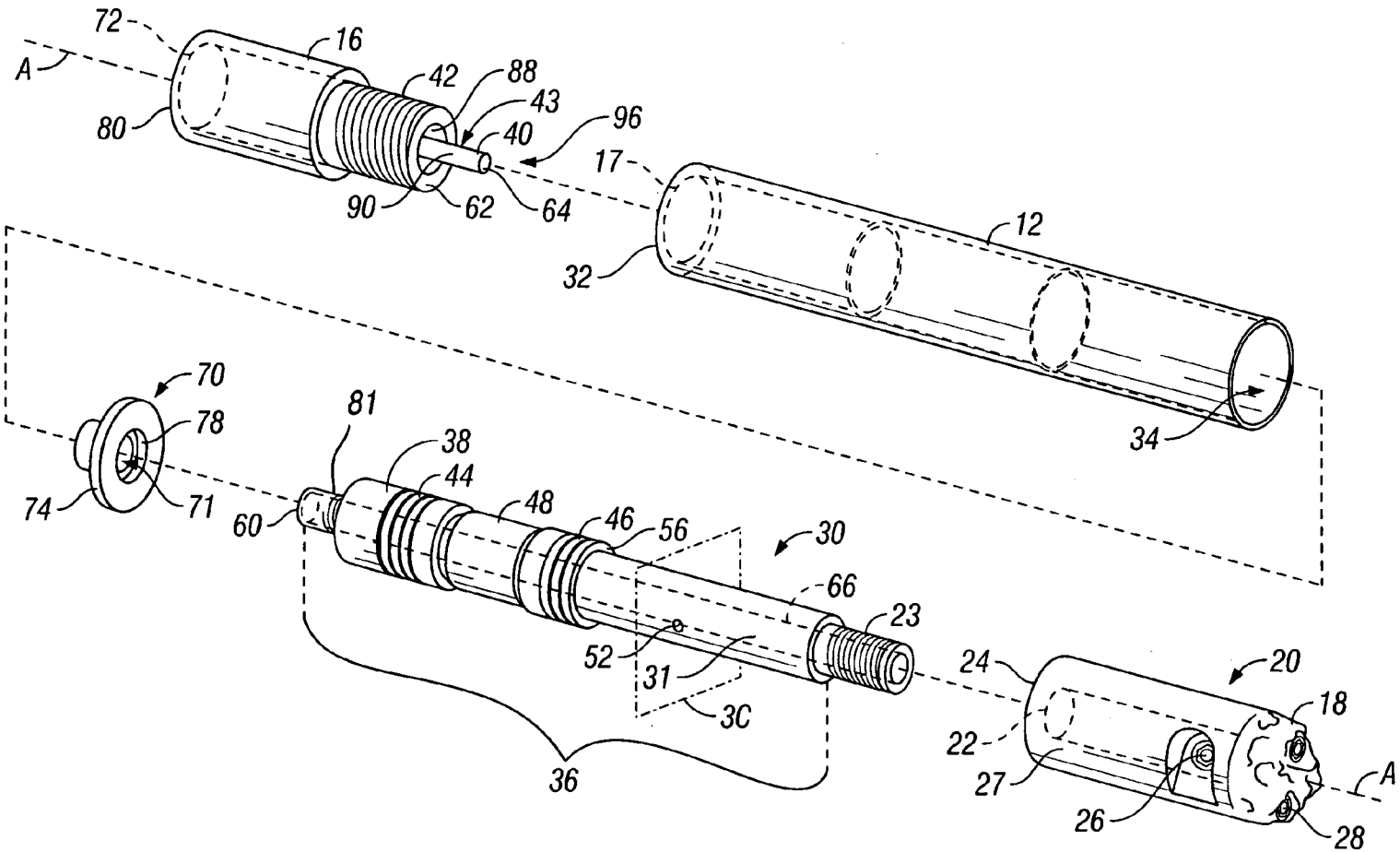
FIG. 2 is a partial exploded view of the jet motor.

Referring to FIG. 2, drill bit 20 is generally a closed cylindrical structure with an open connection end 24. Channel 22 extends inwardly of bit 20 from connection end 24. In an exemplary embodiment, threading is provided on the interior surface of drill bit 20 proximate connection end 24 for threaded connection to threaded lower connector 23 of power shaft assembly 36.

Figure 3A:
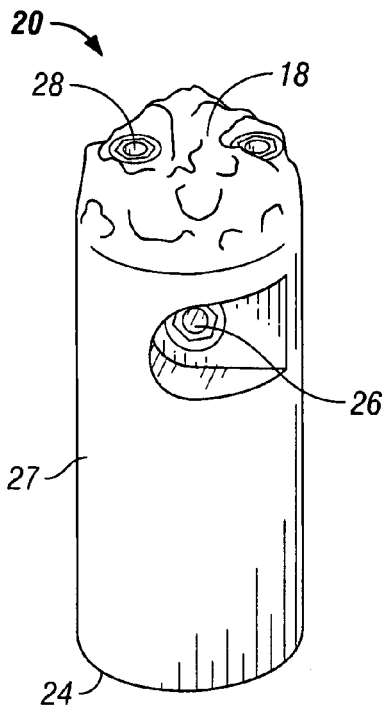
FIG. 3A is a perspective view of the drill bit of the jet motor.
Figure 3B:
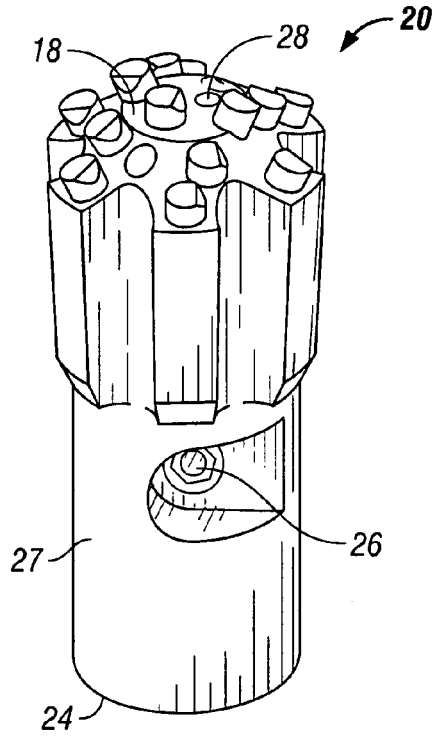
FIG. 3B is a perspective view of an alternative embodiment of the drill bit.

In an exemplary embodiment, drill bit face 18 is textured to model a rock configuration as depicted in FIG. 3A. Alternatively, drill bit face 18 is comprised of a plurality of nodes, as seen in FIG. 3B.

At least one rotation nozzle 26 is disposed in cylinder wall 27 of drill bit 20. In an exemplary embodiment at least two rotation nozzles 26 are provided. Rotation nozzles 26 are in fluid communication with the interior channel 22 of drill bit 20 and allow fluid flow from channel 22 to the exterior of bit 20.

Figure 4A:
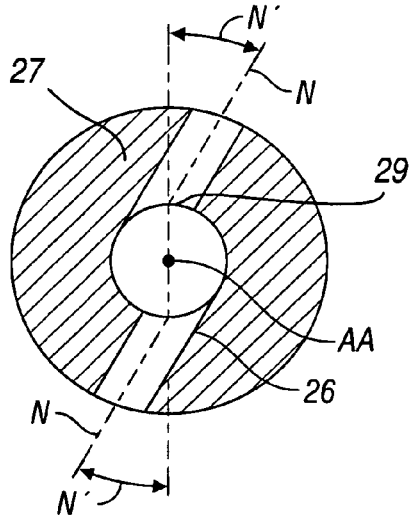
FIG. 4A is a cross-sectional view of the drill bit taken along line 4A-4A in FIG. 4.

Referring to FIG. 4A, nozzles 26 each have an axis NN. Axes NN are each disposed generally perpendicularly to axis AA. Axes NN of the rotation nozzles 26 are each oriented radially to allow fluid expulsion from nozzles 26 to provide rotational thrust in a desired direction. Specifically, the angle N' of each axis NN with respect to a plane passing through axis AA and interior opening 29 of cylinder wall 27 is acute in the preferred direction of rotation.

Figure 4:
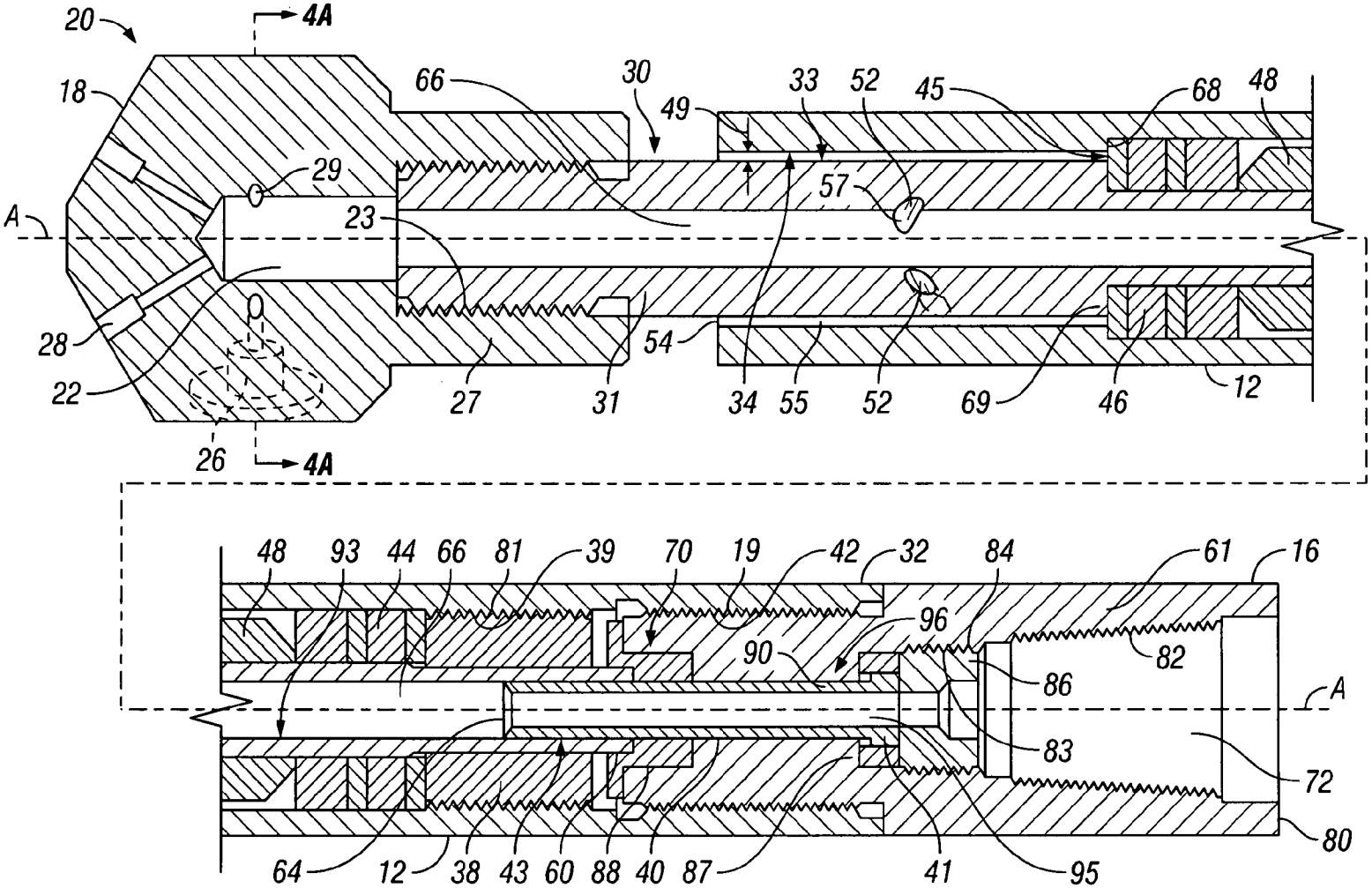
FIG. 4 is a cross-sectional view of the jet motor taken along axis A-A in FIG. 1 and through the drive nozzles.
Figure 4B:
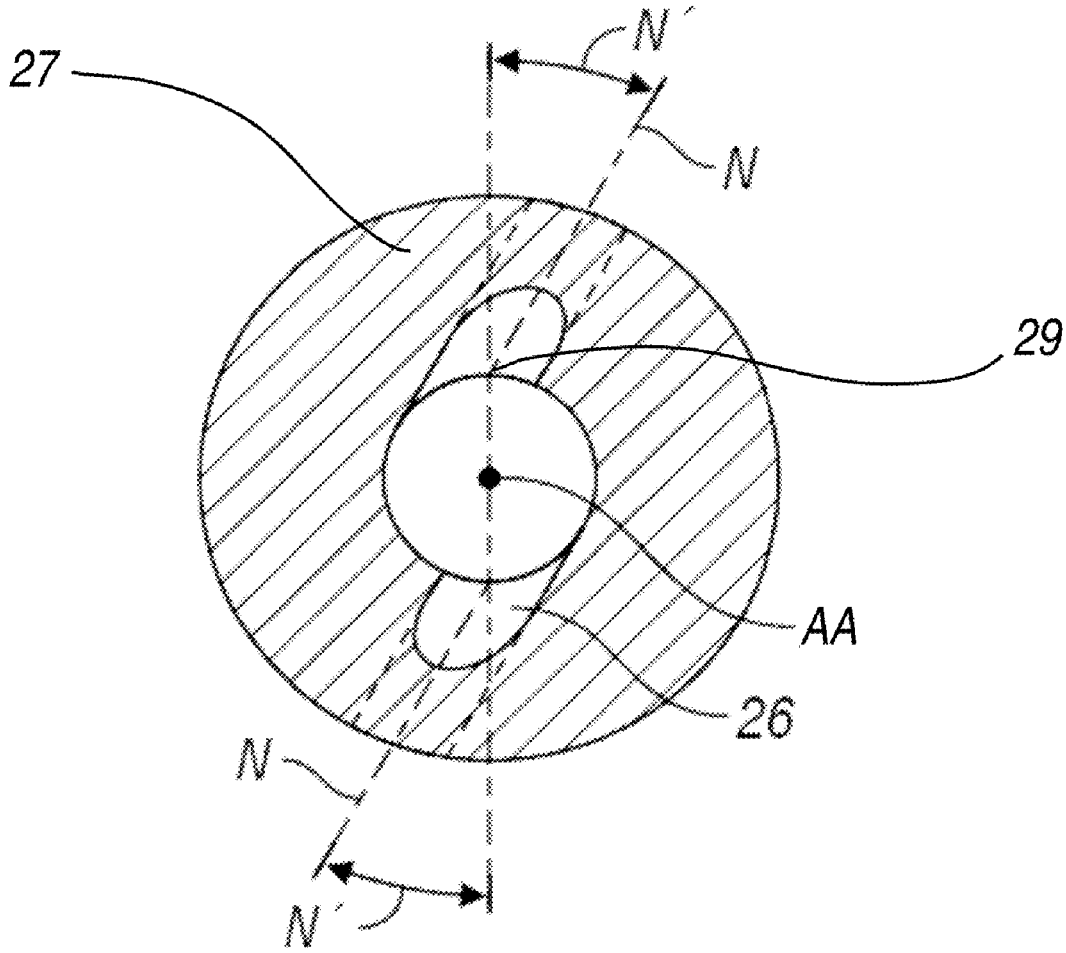
FIG. 4B is a cross-sectional view of an alternative embodiment of the drill bit taken through the nozzles.

Referring to FIG. 4B, in an alternative embodiment, nozzles 26 may each be oriented from a plane normal to axis AA at the interior opening 29 of each nozzle 26 to provide a forward thrust from fluid escaping through nozzles 26.

Figure 3C:
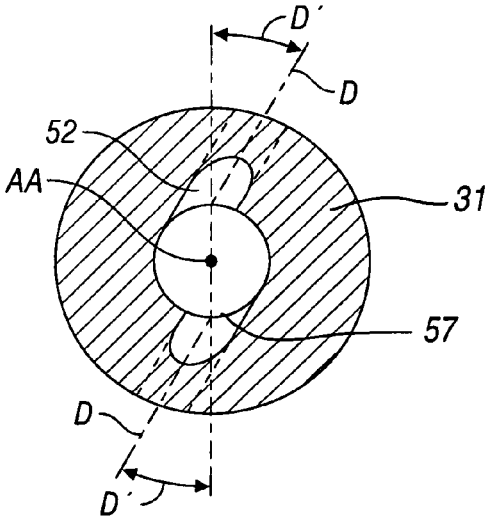
FIG. 3C is a cross-sectional view of the power shaft of the jet motor taken along plane 3C in FIG. 2.

Referring to FIGS. 2, 3 and 4, cutting nozzles 28 are provided in bit face 18. Cutting nozzles 28 are in fluid communication with interior channel 22 of drill bit 20. The axes of cutting nozzles 28 may be oriented parallel with axis AA or at an angle to axis AA. Fluid escaping from nozzles 28 provides cutting forces and washes loose materials away from bit face 18.

Control sleeve 12 is generally composed of an elongated cylindrical barrel body, with a sleeve channel 17 passing therethrough. Sleeve channel 17 is oriented along axis AA.

Referring to FIG. 4. control sleeve 12 is provided with threading 19 at its upper end 32 for threaded connection to threaded lower end 42 of upper subassembly 16. Upper subassembly 16 is provided with threading 82 at its end 80 to allow connection to a drill string or tubing (not shown). Such threaded connections are commonly practiced. Accordingly, control sleeve 12, after installation on a drill string or tubing, is in a fixed position in relation to the drill string or tubing.

Referring to FIGS. 2 and 4, power shaft assembly 36 is depicted. Power shaft assembly 36 includes power shaft 30, lower radial bearing 46, thrust bushing 48, upper radial bearing 44, retainer 38 and upper thrust bushing 70.

Power shaft 30 comprises a hollow cylinder structure having an internal channel 66 aligned with axis AA. Internal channel 66 allows fluid communication from a drill string or tube (not shown) to channel 22 of drill bit 20.

Power shaft 30 is constructed and sized to rotate within control sleeve 12 with lower radial bearing 46 and upper radial bearing 44 providing radial support. As drill bit 20 is fixedly attached to power shaft 30, drill bit 20 and power shaft 30 rotate together in relation to control sleeve 12.

Thrust bushing 48 extends intermediate lower radial bearing 46 and upper radial bearing 44.

A retainer nut 38 is provided on power shaft 30 intermediate upper radial bearing 44 and upper end 60 of power shaft 30. Retainer nut 38 is provided with an internal threading 39 to attach to corresponding threading 81 provided on power shaft 30 to retain radial bearings 44 and 46 and thrust bushing 48 intermediate retainer nut 38 and a shoulder 69 on power shaft 30 and shoulder 68 on control sleeve 12, as seen in FIG. 4 (upper portion).

Power shaft 30, control sleeve 12, shoulder 68 and end 56 of lower radial bearing 46 define a blind annular space 55 intermediate exterior surface 33 of power shaft 30 and inner surface 34 of control sleeve 12, blind annular space 55 having an upper end 45 defined by end 56 of lower radial bearing 46 and shoulder 68 of control sleeve 12.

In an alternative embodiment, an annular seal (not shown) may be provided at end 56 of lower radial bearing 46 to define the upper end 45 of annular space 55. An annular opening 54 of annular space 55 is defined intermediate control sleeve 12 and power shaft 30.

At least one drive nozzle 52 extends through wall 31 of power shaft 30. In an exemplary embodiment, at least two drive nozzles 52 are provided spaced within wall 31 of power shaft 30. Drive nozzles 52 are in fluid communication with the internal channel 66 of power shaft 30.

Drive nozzles 52 are located intermediate annular opening 54 of annular space 55 and upper end 45 of annular space 55. Drive nozzles 52 allow fluid flow from channel 66 to annular space 55.

Drive nozzles 52 each have an axis DD, as seen in FIG. 3C. Axes DD are each oriented angularly with respect to axis AA, the angle being acute in the direction of upper end 60 of power shaft 30 and obtuse with respect to the direction of the threaded lower connector 23. Accordingly, drive nozzles 52 are each oriented rearward from a plane normal to axis AA at the interior opening 57 of each nozzle 52. Such orientation provides a forward thrust from fluid escaping through nozzles 52.

Referring to FIG. 3C, axes DD of the drive nozzles 52 are each angled radially to allow fluid expulsion from nozzles 52 to provide rotational thrust in a desired direction. Specifically, the angle D' of each axis DD with respect to a plane passing through axis AA and shaft wall 31 at interior opening 57 is acute in relation to the plane.

In the exemplary embodiment shown, rotation nozzles 26 and drive nozzles 52 are depicted. In an alternative embodiment, not shown, ports may be provided without nozzles to achieve the results of the invention. The principles taught in this invention apply with ports used in lieu of rotation nozzles 26 or drive nozzles 52.

Inner surface 34 of control sleeve 12 is spaced from exterior surface 33 of power shaft 30. The extent of separation is gap 49. In operation, fluid forced through internal channel 66 is expelled through drive nozzles 52. Upon impinging inner surface 34, a reactive force is incurred, thereby enhancing the rotation of power shaft 30.

In an exemplary embodiment, gap 49 is in the range of 0.0381 cm to 0.0762 cm (0.015" to 0.030") for a tool having a nominal diameter in the range of 3.175 cm to 4.445 cm (1.25" to 1.75"). In an exemplary embodiment, gap 49 is in the range of 0.508 cm to 0.635 cm (0.20" to 0.25") for a tool having a nominal diameter in the range of 10.4775 cm to 12.065 cm (4.125" to 4.75"). Generally, gap 49 is effective in a range of ratios of gap 49 to nominal diameter of the control sleeve 12 (gap:sleeve diameter) as follows: Ratio of 1:125 to ratio of 1:17. Depending on various application requirements, including the fluid used, nozzle size, pressure and other factors, ratios outside the foregoing range may be preferred.

Referring to FIGS. 2 and 4, upper subassembly 16 comprises a generally hollow cylindrical body 61 having a connecting threading 82 for connecting to a drill string or tubing (not shown) at its upper end 80, and connecting threading threaded lower end 42 for connecting to control sleeve 12 at control sleeve threading 19. Upper subassembly 16 includes an interior channel 72 aligned with axis AA.

An injection tube 96 is provided in upper subassembly 16. Injection tube 96 includes an elongated tube 40 and tube head 41. Tube head 41 has a larger diameter than tube 40. A tube retaining nut 86 is provided to retain tube head 41 between retaining nut 86 and a shoulder 87 provided in upper subassembly 16. Retaining nut 86, tube head 41 and tube 40 define a continuous tube channel 95 aligned with axis AA. Retaining nut 86 has connecting threading 84 for threaded connection to internal connecting threading 83 provided in upper subassembly 16.

In an exemplary embodiment, injection tube 96 is retained in position by the retaining nut 86 and shoulder 87. Injection tube 96 is free to rotate about axis AA independent of the rotation of power shaft 30 and upper subassembly 16.

Upper subassembly 16 is provided with a cylindrical inset 88 at its lower end 62. A thrust bushing 70 is provided to provide a bearing surface intermediate upper subassembly 16 and power shaft assembly 36. Thrust bushing 70 additionally encloses and provides radial support for tube 40.

Tube 40 extends past the lower end 62 of upper subassembly 16 into the channel 66 of power shaft 30.

The interior surface 71 of thrust bushing 70 is sized and constructed to encircle the exterior surface 43 of tube 40 but to allow rotation between the surfaces. Thrust bushing 70 further contains a flange 74 extending radially outward. Flange 74 is received between the lower end 62 of upper subassembly 16 and upper end 60 of power shaft 30. Thrust bushing 70 includes a cylindrical inset 78 to receive a segment of power shaft 30 at the upper end 60 of power shaft 30. Cylindrical inset 78 is sized and constructed to slidably receive end 60 of power shaft 30.

The diameter of outer surface 43 of injection tube 96 is preferably only slightly smaller than the diameter of channel 66 allowing injection tube 96 to be slidably received in channel 66.

In an exemplary embodiment of the present invention, the injection tube 96 with a tube wall 90 having a width such that the wall will expand slightly when an appropriate operating pressure is applied internal of wall 90 in tube channel 95. Such slight expansion creates a seal between the exterior surface 43 of tube wall 90 and the interior surface 93 of power shaft 30 that defines channel 66.

In an exemplary embodiment, the tube wall 90 is provided with a slight flare proximate its lower end 64 to enhance sealing of tube wall 90 and the interior surface 93. A preferred flare angle is up to five degrees outwardly from the tube wall segment that is not flared.

In summary, the power shaft assembly 36 is fixedly attached to the drill bit 20. Power shaft assembly 36 is rotatable within control sleeve 12. A blind annular space 55 is defined between power shaft 30 and control sleeve 12.

In operation, jet motor 10 of the present invention is attached to a drill string or tube (not shown). A fluid (drilling fluid or gas) is introduced into the drill string or tube at determined pressures. Pressure is applied to the fluid forcing the fluid through aligned channels 72, 95, 66 and 22. The fluid is forced through drive nozzles 52, rotation nozzles 26 and cutting nozzles 28. The pressure from the fluid in channels 66 and 22 is greater than the ambient downhole pressure. Differential pressure at rotation nozzles 26 and drive nozzles 52 create rotational torque on the drill bit 20 and power shaft 30.

Importantly, the proximity of inner surface 34 of control sleeve 12 provides a surface that is stationary relative to power shaft 30. The expansive force of the fluid escaping drive nozzles 52 impinging surface 34 enhances the rotational torque on power shaft 30.

Gap 49 may be determined to provide desired reactive force of fluid expelled through drive nozzles 52 at inner surface 34. In addition, the force of the drilling fluid may be manipulated in order to control the thrust of the drilling fluid against the sleeve inner surface 34 through the drive nozzle 52 thereby controlling the rotation of the power shaft 30 and the drill bit 20.

As the drive nozzles 52 are located intermediate opening 54 of annular space 55 and upper end 45, fluid forced out of drive nozzles 52 is forced out of opening 54, thereby continually washing annular space 55 and preventing accumulation of debris in annular space 55.

Figure 5:
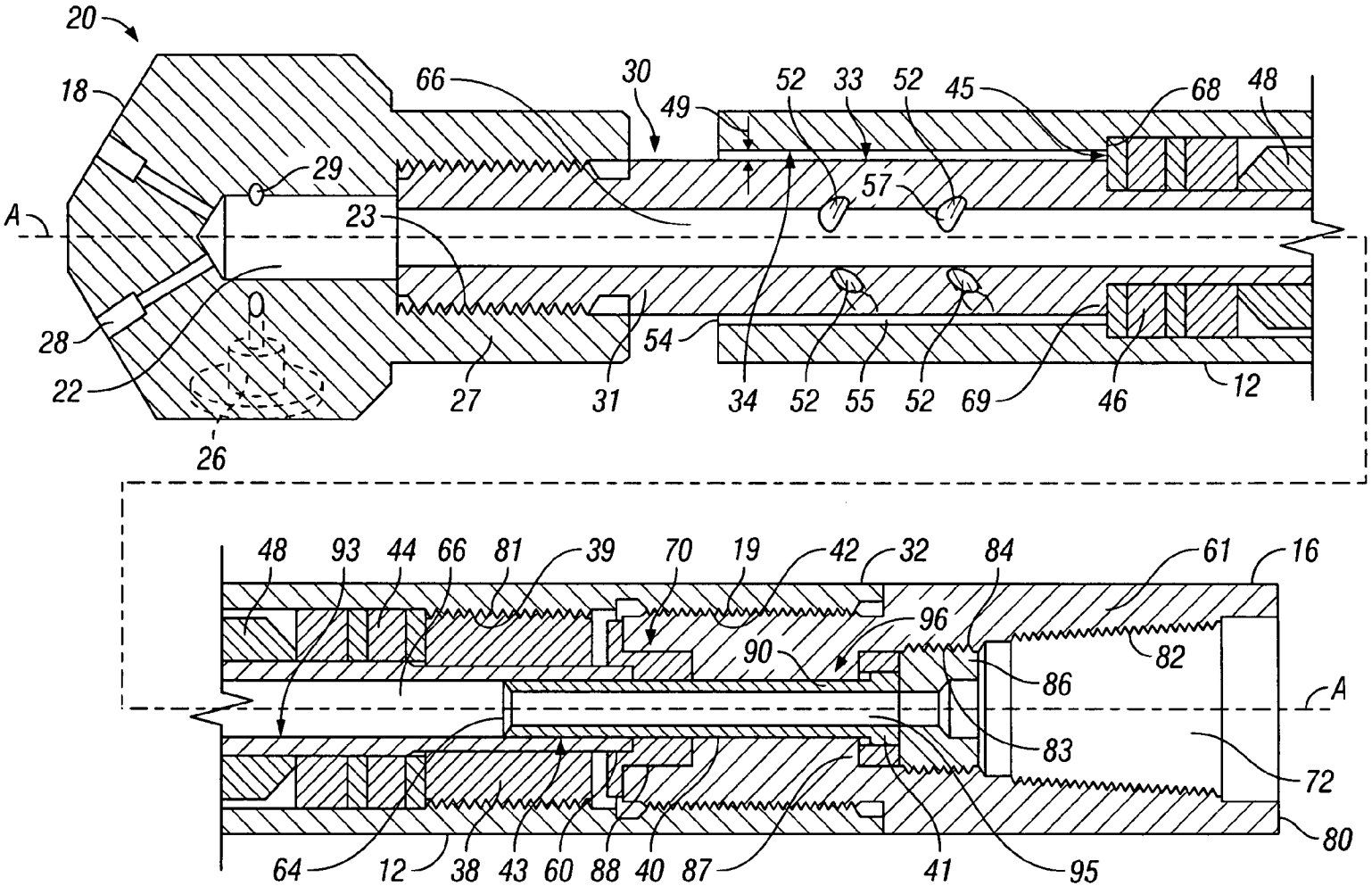
FIG. 5 is a cross-sectional view of an alternative embodiment of the jet motor.

FIG. 5 depicts an alternative exemplary embodiment wherein four drive nozzles 52 are located on power shaft 30 in order to increase the amount of fluid expelled through the drive nozzles 52. Drive nozzles 52 are depicted as symmetrically situated opposing pairs with respect to each other. Drive nozzles 52 may also be situated asymmetrically or in any combination of the two.

In an exemplary embodiment, an appropriate gas, such as nitrogen, may be utilized as the fluid medium. The construction of the present invention, particularly the construction of injection tube wall 90 with expansion capability upon application of appropriate fluid pressure in tube channel 95 together with fit of exterior surface 43 of tube wall 90 and the interior surface 93 of power shaft 30 allows the creation of an effective seal even though the fluid is a gas.

The exemplary embodiment providing a flared lower end 64 of tube wall 90 provides an effective seal at interior surface 93 as internal fluid pressure is applied at the open end of lower end 64.

The foregoing description of the invention illustrates a preferred embodiment thereof. Various changes may be made in the details of the illustrated construction within the scope of the appended claims without departing from the true spirit of the invention. The present invention should only be limited by the claims and their equivalents.

I claim:

1. A motor for a downhole tool comprising:

a cylindrical control sleeve;

a power shaft;

said power shaft at least partially surrounded by said control sleeve;

said power shaft rotatable in relation to said control sleeve;

said power shaft having a power shaft wall;

said power shaft having an interior power shaft channel;

at least one opening provided in said power shaft wall;

said at least one opening in fluid communication with said power shaft channel;

said control sleeve having an interior control sleeve surface;

said at least one opening in said shaft wall having an opening axis;

said opening axis oriented toward said control sleeve surface;

said power shaft having a power shaft axis and upper and lower ends;

said opening axis of said at least one opening in said power shaft wall acutely oriented in relation to the direction of the upper end of said power shaft, and obtusely oriented in relation to the lower end thereof;

said at least one opening having an interior opening;

said opening axis of said at least one opening in said power shaft wall acutely oriented with respect to a plane passing through said power shaft axis and said power shaft wall at said interior opening;

said control sleeve connected to an upper subassembly;

said upper subassembly connectable to a drill string; said upper subassembly having an interior upper channel;

an injection tube providing fluid communication from said interior upper channel to said power shaft channel;

said injection tube comprising a tube head and a tube;
said tube head disposed within said upper subassembly;
said tube extending into said power shaft channel; and
wherein said injection tube having a lower tube end and an opposite upper tube end, wherein said injection tube is connected to said upper subassembly at said upper tube end.

2. The motor of claim 1, further comprising:
said control sleeve and said power shaft defining an annulus;
said at least one opening in said shaft wall having an opening outlet;
said annulus having an annulus closed end and an annulus open end;
said opening outlet is intermediate said annulus closed end and said annulus open end; and
said annulus having a uniform annulus gap between said annulus closed end and said annulus open end.

3. The motor of claim 2, further comprising:
said power shaft having an interior power shaft surface;
said injection tube having an exterior tube surface;
said tube slidably received in said power shaft channel;
said injection tube constructed to expand at a predetermined pressure; and
wherein said exterior tube surface, at said lower tube end, forms a seal against said interior power shaft surface upon application of a predetermined pressure.

4. The motor of claim 1, further comprising:
a drill bit operationally connected to said power shaft;
said drill bit having a cylinder wall;
said drill bit having a longitudinal drill bit axis;
at least one drill bit opening provided in said cylinder wall;
said at least one drill bit opening having an opening axis;
said opening axis of said at least one drill bit opening in said cylinder wall acutely oriented in relation to the direction of the upper end of said power shaft;
said at least one drill bit opening having an interior opening; and
said opening axis of said at least one drill bit opening in said cylinder wall acutely oriented with respect to a plane passing through said drill bit axis and said cylinder wall at said interior opening.

5. The motor of claim 1, further comprising:
said power shaft having an interior power shaft surface;
said injection tube having an exterior tube surface;
said injection tube constructed to expand at a predetermined pressure; and
wherein said exterior tube surface, at said lower tube end, forms a seal against said interior power shaft surface upon application of a predetermined pressure.

6. The motor of claim 5, further comprising:
said injection tube having a flared opening proximate said lower tube end; and
said lower tube end received in said power shaft channel proximate said power shaft surface.

7. The motor of claim 1, wherein said at least one opening provided in said shaft wall comprising a nozzle.

8. A motor for a downhole tool comprising:
a cylindrical control sleeve;
a power shaft;
said power shaft at least partially surrounded by said control sleeve;
said power shaft rotatable in relation to said control sleeve;
said power shaft having a power shaft wall;
said power shaft having an interior power shaft channel;
at least one nozzle provided in said power shaft wall;
said at least one nozzle in fluid communication with said power shaft channel;
said control sleeve having an interior control sleeve surface;
said at least one nozzle having a nozzle axis;
said nozzle axis oriented toward said control sleeve surface;
said control sleeve connected to an upper subassembly;
said upper subassembly having an interior upper channel;
an injection tube providing fluid communication from said upper channel to said power shaft channel;
said power shaft having an interior power shaft surface;
said injection tube having a lower tube end and an opposite upper tube end and an exterior tube surface;
said injection tube constructed to expand at a predetermined pressure;
wherein said exterior tube surface, at said lower tube end, forms a seal against said interior power shaft surface upon application of a predetermined pressure;
said control sleeve and said power shaft defining an annulus;
said annulus having an annulus closed end and an annulus open end;
said at least one nozzle having a nozzle outlet;
said nozzle outlet intermediate said annulus closed end and said annulus open end; and
said annulus having a uniform annulus gap between said annulus closed end and said annulus open end.

9. The motor of claim 8, further comprising:
said power shaft having a power shaft axis and an upper end and a lower end;
said nozzle axis of said at least one nozzle in said power shaft wall acutely oriented in relation to the direction of said upper end of said power shaft, and obtusely oriented in relation to said lower end of said power shaft;
said at least one nozzle having an interior opening; and
said nozzle axis of said at least one nozzle in said power shaft wall acutely oriented with respect to a plane passing through said power shaft axis and said power shaft wall at said interior opening.

10. The motor of claim 8, further comprising:
said upper subassembly connectable to a drill string;
a drill bit operationally connected to said power shaft;
said power shaft having an upper end and a lower end;
said drill bit having a cylinder wall;
said drill bit having a longitudinal drill bit axis;
at least one drill bit opening provided in said cylinder wall;
said at least one drill bit opening having an opening axis; and
said opening axis of said at least one drill bit opening in said cylinder wall acutely oriented in relation to the direction of the upper end of said power shaft.

11. The motor of claim 10, further comprising:
said injection tube comprising a tube head and a tube;
said tube head in said upper subassembly;
said tube extending into said power shaft channel;
said tube slidably received in said power shaft channel; and
said injection tube connected to said upper subassembly.

12. The motor of claim 11, further comprising:
said injection tube independently rotatable in relation to said upper subassembly; and
said injection tube independently rotatable in relation to said power shaft.

13. The motor of claim 12, further comprising:

said tube having a flared opening proximate said lower tube end; and said lower tube end received in said power shaft channel proximate said power shaft surface.

14. The motor of claim 8, further comprising:

a drill bit operationally connected to said power shaft;

said drill bit having a cylinder wall;

said drill bit having a longitudinal drill bit axis;

at least one drill bit opening provided in said cylinder wall;

said at least one drill bit opening having an opening axis;

said at least one drill bit opening having an interior opening; and said opening axis of said at least one drill bit opening in said cylinder wall acutely oriented with respect to a plane passing through said drill bit axis and said cylinder wall at said interior opening.

15. A motor for a downhole tool comprising:

a cylindrical control sleeve;

a power shaft;

said power shaft at least partially surrounded by said control sleeve;

said power shaft rotatable in relation to said control sleeve;

said power shaft having a power shaft wall;

said power shaft having an interior power shaft channel;

at least one nozzle provided in said power shaft wall;

said at least one nozzle in fluid communication with said power shaft channel;

said control sleeve having an interior control sleeve surface;

said at least one nozzle having a nozzle axis;

said nozzle axis oriented toward said control sleeve surface;

said control sleeve connected to an upper subassembly;

said upper subassembly having an interior upper channel;

an injection tube providing fluid communication from said upper channel to said power shaft channel;

said power shaft having an interior power shaft surface;

said injection tube having a lower tube end and an opposite upper tube end;

said injection tube having a flared opening proximate said lower tube end; and said lower tube end received in said power shaft channel proximate said power shaft surface.

16. The motor of claim 15, further comprising:

said power shaft having an upper end and a lower end;

said nozzle axis of said at least one nozzle in said shaft wall acutely oriented in relation to the direction of said upper end of said power shaft, and obtusely oriented in relation to said lower end of said power shaft;

said at least one nozzle having an interior opening;

said nozzle axis of said at least one nozzle in said power shaft wall acutely oriented with respect to a plane passing through said power shaft axis and said power shaft wall at said interior opening;

a drill bit operationally connected to said power shaft;

said drill bit having a cylinder wall;

said drill bit having a longitudinal drill bit axis;

at least one drill bit nozzle provided in said cylinder wall;

said at least one drill bit nozzle having a drill bit nozzle axis;

said drill bit nozzle axis of said at least one drill bit nozzle in said cylinder wall acutely oriented in relation to the direction of the upper end of said power shaft;

said at least one drill bit nozzle having a drill bit nozzle interior opening; and said drill bit nozzle axis of said at least one drill bit nozzle in said cylinder wall acutely oriented with respect to a plane passing through said drill bit axis and said cylinder wall at said drill bit nozzle interior opening.

17. The motor of claim 15, further comprising:

said control sleeve and said power shaft defining an annulus;

said annulus having an annulus closed end and an annulus open end;

said at least one nozzle having a nozzle outlet;

said nozzle outlet intermediate said annulus closed end and said annulus open end; and said annulus having a uniform annulus gap between said annulus closed end and said annulus open end.

18. The motor of claim 17, further comprising:

said injection tube having an exterior tube surface and said injection tube constructed to expand at a predetermined pressure; and wherein said exterior tube surface, at said lower tube end, forms a seal against said interior power shaft surface upon application of a predetermined pressure.

* * * * *